US006831541B1

(12) United States Patent
Seidler

(10) Patent No.: US 6,831,541 B1
(45) Date of Patent: Dec. 14, 2004

(54) MULTI-STABLE MAGNETIC ARTICLE

(75) Inventor: David Seidler, Forest Hills, NY (US)

(73) Assignee: Concept Workshop Worldwide, LLC, New York, NY (US)

( * ) Notice: Subject to any disclaimer, the term of this patent is extended or adjusted under 35 U.S.C. 154(b) by 0 days.

(21) Appl. No.: 10/663,210

(22) Filed: Sep. 16, 2003

(51) Int. Cl.[7] ..... H01F 7/02
(52) U.S. Cl. ..... 335/306; 206/818
(58) Field of Search ..... 336/110; 132/294; 335/299–306; 206/818, 823, 581

(56) References Cited

U.S. PATENT DOCUMENTS 4,045,291 A * 8/1977 Berger ..... 435/297.5
5,005,697 A * 4/1991 Jimbo et al. ..... 206/235
5,135,012 A * 8/1992 Kamen et al. ..... 132/294
5,373,862 A * 12/1994 Blachut ..... 132/294
6,631,806 B2 * 10/2003 Jackson ..... 206/581

* cited by examiner

*Primary Examiner*—Tuyen T. Nguyen
(74) *Attorney, Agent, or Firm*—Amster, Rothstein & Ebenstein

(57) ABSTRACT

A multi-stable magnetic article has plates which are generally juxtaposed and independently transformable in respective parallel planes between a stable closed orientation and a plurality of stable open orientations. The article is useful as a small cosmetic case containing a plurality of cosmetics on a single plate, all cosmetics being covered in the stable closed orientation and a selected one or more cosmetics being exposed in each of the stable open orientations.

41 Claims, 7 Drawing Sheets

FIG. 1A
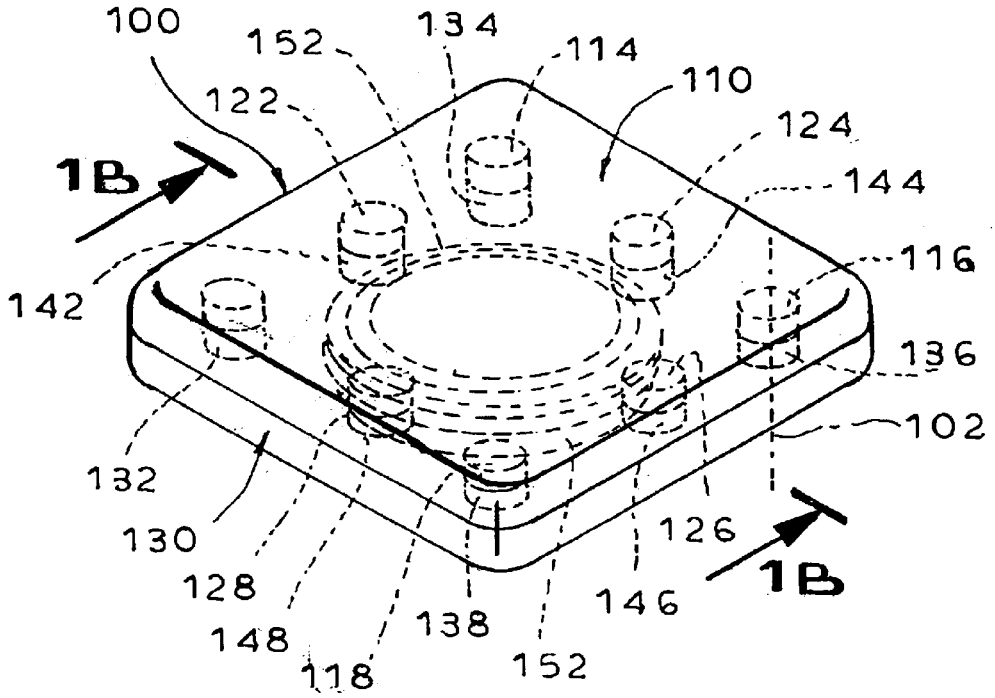
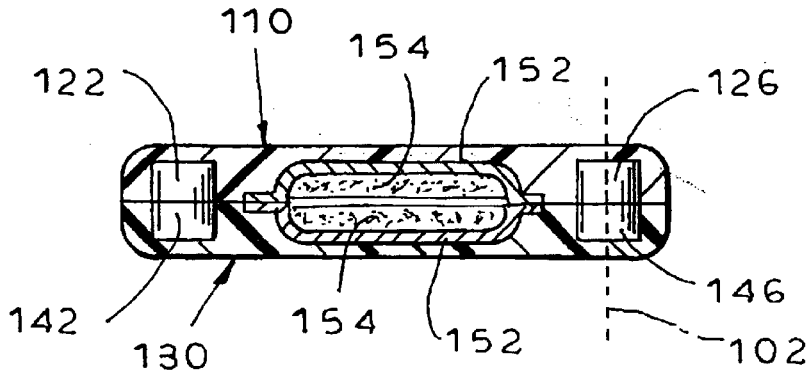
FIG. 1B

MULTI-STABLE MAGNETIC ARTICLE

BACKGROUND OF THE INVENTION

The present invention relates to a magnetic article such as a cosmetic case wherein upper and lower plates are connected together by magnetic attraction forces, and more particularly to such an article wherein the plates may be moved between a stable closed orientation and a plurality of stable open orientations.

It is known to provide a magnetic article comprising a first plate of non-magnetic material having disposed therein a first magnet for movement therewith, and a second plate of non-magnetic material having disposed therein a second magnet for movement therewith. The first and second magnets are essentially superposed and disposed in the same magnetic orientation. The first and second plates are generally juxtaposed and independently pivotable in respective parallel planes transverse to a magnetic axis defined by the first and second magnets between (i) a closed orientation wherein the first and second plates are essentially superposed and (ii) an open orientation wherein the first and second plates are overlapping but essentially not superposed.

Where the magnets are circular in plan (e.g., cylindrical), such an article is typically not stable in either the closed or open orientations—that is, the plates are pivotable relative to one another about the hinge axis at all times. At the very least, a surrounding cover must be used to maintain the plates in the closed orientation. Further, once the cover is removed and the plates moved into the open orientation, there is no magnetic action maintaining the plates in the open orientation, and they may accidentally swing back into the closed orientation.

These functional disadvantages of the conventional magnetic article may be overcome by using rectangular magnets rather than circular magnets so that the article exhibits a stable closed orientation and a stable open orientation—in other words, so that the article is bistable. Another way to overcome these disadvantages is to provide the facing surfaces of two plates with stop structures and abutment structures which interact to provide at least a semi-stable closed orientation and at least a semi-stable open orientation. However, none of the known magnetic articles are multi-stable—that is, providing a stable closed orientation and a plurality of different stable open orientations.

A magnetic article is especially useful as a cosmetic case wherein an upper plate acts as a cover or mirror-bearing plate and a lower plate acts as a base containing a plurality of different cosmetics. The base plate may be divided such that each cosmetic occupies a separate half, a separate third, or a separate quarter of the plate, and it would be highly desirable for the cosmetic case to be moveable between a stable closed or storage orientation wherein none of the cosmetics were exposed and a plurality of stable open or use orientations wherein each stable open or use orientation exposed less than all, and preferably only a single one, of the cosmetics.

Accordingly, it is an object of the present invention to provide a multi-stable magnetic article.

Another object is to provide such an article wherein, in a preferred embodiment, the plates are moveable between a stable closed orientation and a plurality of stable open orientations.

A further object is to provide such an article wherein, in a preferred embodiment, first and second plates are transformable by being independently relatively rotatable about at least one pivot axis.

It is also an object of the present invention to provide such an article wherein, in a preferred embodiment, first and second plates are transformable by being independently relatively linearly translatable along orthogonal axes.

It is another object to provide such an article wherein, in a preferred embodiment, first and second plates are transformable by being independently relatively linearly translatable along diagonal axes.

Yet another object is to provide such an article wherein, in a preferred embodiment, the article is simple and inexpensive to manufacture, use and maintain.

SUMMARY OF THE INVENTION

It has now been found that the above and related objects of the present invention are obtained in a multi-stable magnetic article defining a plurality of spaced apart parallel magnetic axes. The article comprises a first plate of non-magnetic material, and a plurality of spaced apart first magnets disposed in the first plate for movement therewith, as well as a second plate of non-magnetic material, and a plurality of spaced apart second magnets disposed in the second plate for movement therewith. The first and second plates are generally juxtaposed and independently transformable in respective parallel planes transverse to the axes between a stable closed orientation and a plurality of stable open orientations. In the stable closed orientation, the first and second plates are essentially superposed, and at least a plurality of the first magnets and at least a plurality of the second magnets form essentially superposed pairs, each superposed pair containing one of the first magnets and one of the second magnets and defining one of the axes. In each of the plurality of stable open orientations, the first and second plates are overlapping but essentially not superposed, and the first and second magnets of at least one of the superposed pairs of magnets in the closed orientation are essentially not superposed in the open orientation. In each of the superposed pairs, the first and second magnets are in the same magnetic orientation.

In a preferred embodiment of the article, the first and second plates are transformable by being independently relatively pivotable about one of the axes, by being independently relatively linearly translatable along orthogonal axes, and/or by being independently relatively linearly translatable along diagonal axes.

In the closed orientation of a preferred embodiment all of the first magnets and all of the second magnets form the superposed pairs. Either none or at most one of the superposed pairs remains superposed throughout movement between adjacent orientations. At least one superposed pair separates during movement between adjacent orientations, preferably with the first magnet thereof becoming newly superposed with another of the second magnets.

A preferred embodiment of the article is a cosmetic case wherein the first plate defines a base of the case and the second plate defines a cover of the case, the base and cover being relatively transformable between the closed and open orientations. Where the article is a cosmetic case, at least one of the plates preferably carries at least two different cosmetics, each of the different cosmetics being individually and exclusively exposed for use in at least one respective stable open orientation. Preferably adjacent facing surface of the first and second magnets are substantially flush with, or recessed relative to, adjacent facing surfaces of the first and second plates, respectively. The first and second magnets are preferably substantially flat rectangles or flat cylinders.

Preferably the first plate and the first magnets are readily manually separable from the second plate and the second magnets to deconstruct the article, and the first plate and the first magnets are readily manually attachable to the second plate and the second magnets to reconstitute the article. The plates, including their respective magnets, are readily manually separable and readily manually attachable in the same or a different sequence of plates. The article is devoid of a physical article pin connecting the first and second plates.

In one preferred embodiment the first and second plates are relatively pivotable about at least one axis to an additional stable open orientation. The article is at least tristable, preferably at least quadristable, and optimally at least pentastable. The article preferably has three of the first magnets and three of the second magnets or at least four of the first magnets and at least four of the second magnets (optimally at least eight of each).

Optionally at least one of the superposed pairs is in a different magnetic orientation than another of the superposed pairs.

The non-magnetic material of at least one of the plates is preferably transparent or translucent. The plates are preferably square, circular or oval in plan, although other configurations are feasible.

Opposed major surfaces of each magnet are of opposite polarity. Each article magnetic axis is disposed inwardly of the peripheries of the first and second plates in the closed orientation. Where the plates are square in plan, magnets are preferably disposed adjacent respective corners thereof and are equidistantly spaced apart. Preferably the magnets disposed in each plate define the vertices of a polygon, irrespective of the configuration of the plate, preferably a regular polygon.

In a further preferred embodiment using plates that are square in plan, there are eight of the first magnets and eight of the second magnets, four of each being disposed at respective corners of a plate and four of each being disposed at respective midpoints intermediate the corners of the plate. Where the first and second plates are square, the first and second magnets in the corners are either generally rectangular in planar and physically aligned along diagonals of the plates or generally cylindrical.

In an embodiment incorporating at least three plates, the multi-stable magnetic article defines a plurality of spaced apart parallel magnetic axes. It comprises a first article plate of non-magnetic material, and a plurality of spaced apart first magnets disposed in the first plate for movement therewith; a second plate of non-magnetic material, and a plurality of spaced apart second magnets disposed in the second plate for movement therewith; and a third plate of non-magnetic material, and a plurality of spaced apart third magnets disposed in the third plate for movement therewith. The third plate and the third magnets are disposed at least partially intermediate the first and second plates and magnets, the first, second and third plates being generally juxtaposed and independently transformable in respective parallel planes transverse to the axes between, a stable closed orientation and a plurality of stable open orientations. In the stable closed orientation, the first, second and third plates are essentially superposed, and at least a plurality of the first magnets, at least a plurality of the second magnets and at least a plurality of the third magnets form essentially superposed trios, each superposed trio containing one of the first magnets, one of the second magnets and one of the third magnets and defining one of the magnetic axes. In each of the plurality of stable open orientations, the first, second and third plates are overlapping but essentially not superposed, and the first, second and third magnets of at least one of the superposed trios of magnets in the closed orientation are essentially not superposed in any of the open orientations. In each of the superposed trios, the first, second and third magnets are generally parallel and in the same magnetic orientation. Preferably an outer one of the plates is transparent.

BRIEF DESCRIPTION OF THE DRAWINGS

The above and related objects, features and advantages of the present invention will be more fully understood by reference to the following detailed description of the presently preferred, albeit illustrative, embodiments of the present invention when read in conjunction with the accompanying drawing wherein:

FIG. 1A is an isometric view of a first embodiment of a multi-stable magnetic article according to the present invention in a stable closed orientation;

FIG. 1B is a sectional view thereof taken along the line 1B—1B of FIG. 1A;

DETAILED DESCRIPTION OF THE PREFERRED EMBODIMENTS

As used herein and in the claims, the term "multi-stable" is used in contradistinction to the term "bistable" and requires a minimum of three different stable orientations, whether open or closed.

Figure 1C:
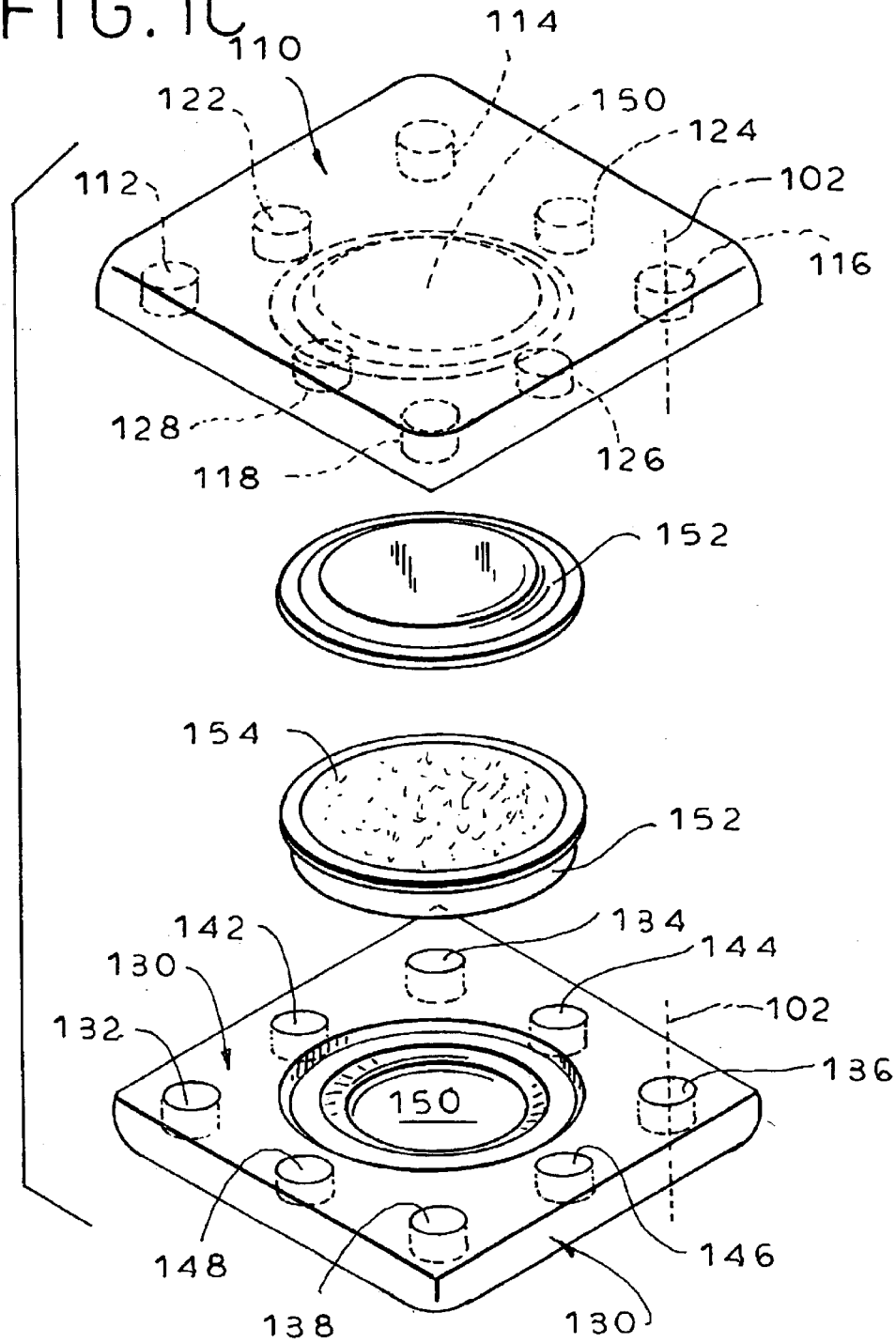
FIG. 1C is an exploded isometric view thereof.

Referring now to the drawing, and in particular to FIGS. 1A–1C thereof, therein illustrated is a first embodiment of a multi-stable magnetic article according to the present invention, generally designated by the reference numeral 100. As will become apparent hereinafter, the embodiment 100 defines a plurality of spaced-apart, parallel magnetic axes 102 and, more particularly, four axes at the corners thereof (one at each corner) and four axes at the midpoints of the sides (one at each midpoint). As will be seen herein below, the article 100 is at least tri-stable (a stable closed orientation and at least two stable open orientations), preferably at least quadra-stable (at least four stable orientations), and optimally at least penta-stable (five stable orientations). The first embodiment 100 has particular utility as a cosmetic case and, more particularly, a modular cosmetic case.

The first embodiment 100 comprises a first plate 110 and a plurality of spaced-apart first magnets disposed on the first plate 110 for movement therewith. More particularly, for a first plate 110 which is square in plan, there are four magnets 112, 114, 116 and 118 disposed in respective corners of the first plate and four magnets 122, 124, 126 and 128 disposed at the midpoints of each side of the first plate 110, equidistantly spaced from the two corner magnets on that side. The first embodiment also comprises a second plate 130 of non-magnetic material, and a plurality of spaced-apart second magnets disposed on the second plate 130 for movement therewith. More particularly, for a second plate 130 which is square in plan, there are four second magnets 132, 134, 136 and 138 disposed in respective corners of the second plate 130 and four second magnets 142, 144, 146 and 148 disposed at the midpoints of each side of the second plate 130, equidistantly spaced from the two corner magnets on that side.

While the first and second plates 110, 130 are illustrated as being square in plan, the plates 110, 130 may be a wide variety of different configurations such as circular, oval, heart shaped, or the like. The non-magnetic material may be natural (for example wood, glass, etc.) or synthetic (e.g., a plastic resin) and, depending upon the use of the article, may be transparent, tinted or opaque. Similarly, while the first magnets 112–128 and the second magnets 132–148 are illustrated as being circular in plan (i.e., as substantially flat cylinders), in embodiment 100 they may have any of a variety of different configurations, such as substantially flat rectangles in embodiment 200 to be described later.

In each figure of the drawing all of the magnets of a plate illustrated in the solid line are shown. While for pedagogic reasons in some figures of the drawing all of the magnets of a given opened plate (illustrated in phantom line) are shown, in other figures some of the magnets of a given opened plate may not be shown. In actuality the magnets may be made invisible to a user simply by at least partially embedding them within their respective plates and covering the exposed magnet surfaces with a very thin layer of the non-magnetic material—e.g., a plastic resin. While it is possible in actuality for a plate to have only corner magnets or only midpoint magnets, for the purpose of full functionality of the present invention all of the magnets described hereinabove should be considered to be on each plate, regardless of whether or not they are shown in a particular figure.

For expository and pedigogic purposes, the various magnets 112–128 and 132–148 have been illustrated as somewhat larger than would in actuality be the case.

The only limitation on the placement of the magnets is that the magnets disposed in each plate 110, 130—that is, magnets 112–128 or 132–148—define the vertices (or vertices and midpoints) of a polygon, irrespective of the configuration of the plates 110, 130. Preferably the polygon is a regular polygon having sides of equal length (without regard to the polygonal or other configuration of the plate 110, 130). Accordingly, it will be appreciated that reference to the corner magnets 112–118 or 132–138 or the midpoint magnets 122–128 or 142–148 as "corner" or "midpoint" magnets, respectively, is merely for expository and pedagogic purposes in light of the illustration of the plates 110, 130 as square in plan. Where the corner and midpoint magnets are rectangular in plan, they are preferably aligned with the diagonals and midpoint lines, respectively, of the square plates, although this is not critical.

The number of magnets illustrated in each plate 110, 130 has also been selected for expository and pedagogic purposes. In fact, a multi-stable magnetic article 100 may be formed with only three first magnets on first plate 110 and only three second magnets on second plate 130. Preferably there are at least four of the first magnets (these being the corner magnets 112–118) and at least four of the second magnets (these being the corner magnets 132–138). The addition of the midpoint magnets 122–128 and 142–148, whether there be only two midpoint magnets per plate or, as illustrated, four midpoint magnets per plate, increases the number of stable open orientations which can be assumed by the article 100.

The first and second plates 110, 130 are generally juxtaposed, one atop the other, and independently transformable in respective parallel planes transverse to the aforementioned magnetic axes 102 between a stable closed orientation, as illustrated in FIG. 1A, and a plurality of stable open orientations A, B, C and D, as illustrated in FIGS. 2–5. Each facing surface of a plate 110, 130 may define at least one concavity 150 (and preferably a plurality of concavities) for receiving, for example, a container 152 carrying a cosmetic 154. In this instance, preferably the exposed surfaces of the cosmetics are recessed slightly below the plane of the facing surface of the respective plate so that the cosmetics do not come in contact with each other or with the facing plate. One or both of the plates 110, 130 is preferably transparent.

In the stable closed orientation illustrated in FIGS. 1A–1C, the first and second plates 110, 130 are essentially superposed (that is, essentially all corresponding portions thereof are vertically aligned). At least a plurality of the first magnets 112–128 and at least a plurality of the second magnets 132–148 form essentially superposed pairs 112, 132; 114, 134; 116, 136 . . . 128, 148. Each such superposed pair contains one of the first magnets 112–128 and one of the second magnets 132–148 (whether they be the corner or midpoint magnets) and defines one of the magnetic axes 102. Of course, in each of the superposed pairs, the first and second magnets of that superposed pair are in the same magnetic orientation (e.g., N-S-N-S or S-N-S-N).

In each of the plurality of stable open orientations illustrated in FIGS. 2–5, the first and second plates 110, 130 are overlapping (that is, have some portions of one plate vertically aligned with some portions of the other plate), but not essentially superposed. More particularly, FIGS. 2 and 4 (the half orthogonal displacement and the half diagonal displacement, respectively) show more overlap, while FIGS. 3 and 5 (the full orthogonal displacement and the pivoting displacement, respectively) show less, and indeed minimal, overlapping. Thus, in each stable open orientation, while there are portions of one plate 110 on top of portions of the other plate 130, there are also portions of the upper plate 110 which extend beyond the lower plate 130 and are thus not on top of portions of the lower plate 130. In each of the plurality of stable open orientations, at least one of the first and second magnets of at least one of the superposed pairs of magnets in the closed orientation is essentially not superposed with its former mate in the open orientation. In other words, in moving from the stable closed orientation to one of the stable open orientations, it is necessary to separate from each other the first and second magnets of at least one initially superposed pair.

In the new stable open orientation, the separated first and second magnets of the original superposed pair may remain isolated (that is, without a mating magnet so that it no longer forms part of a superposed pair) or may form a new superposed pair (that is, by mating or becoming vertically aligned with another mating magnet). Thus, the first magnet 112 of the originally superposed pair of first and second magnets 112, 132 remain unpaired or may join with a new mating magnet to form a new superposed pair of first and second magnets. Similarly, the other magnet 132 of the original superposed pair 112, 132 may remain unpaired or may join with a new mating magnet to form a new superposed pair. Accordingly, while at least one originally superposed pair separates during movement between closed and open orientations, each magnet of that superposed pair may or may not become newly superposed with another magnets. The same, of course, applies to movements from one stable open orientation to another stable open orientation.

The relative positions of the first and second plates 110, 130 are transformed or changed when going between a dosed orientation and an open orientation (or, for that matter, from one open orientation to another open orientation), by any of three separate mechanisms as follows: (a) by being independently relatively linearly translatable along orthogonal axes, (b) by being independently relatively linearly translatable along diagonal axes, or (c) by being independently relatively pivotable about one of the magnetic axes.

Figure 2:
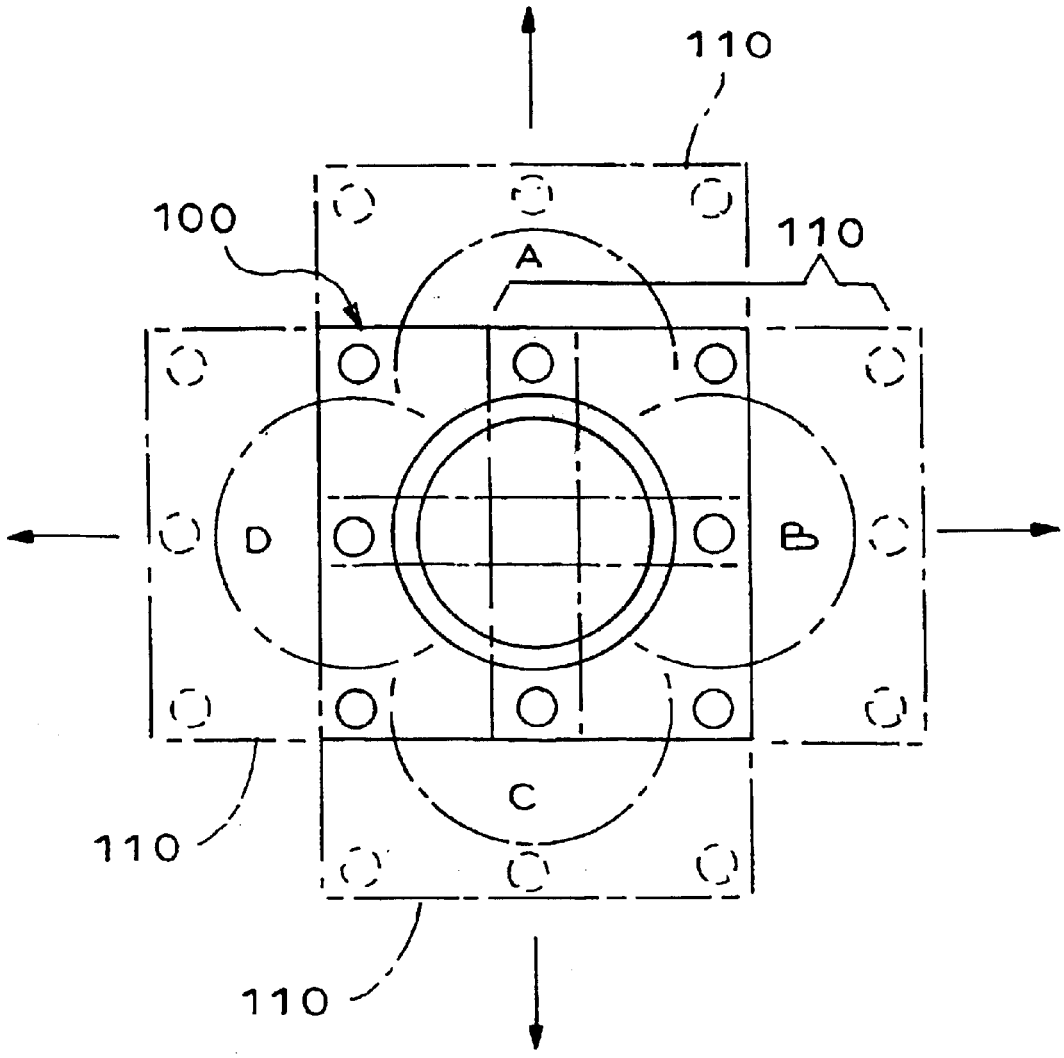
FIG. 2 is a schematic top plan view thereof showing in phantom line possible alternative stable open orientations of the plates where one plate is moved half-way along an orthogonal axis.
Figure 3:
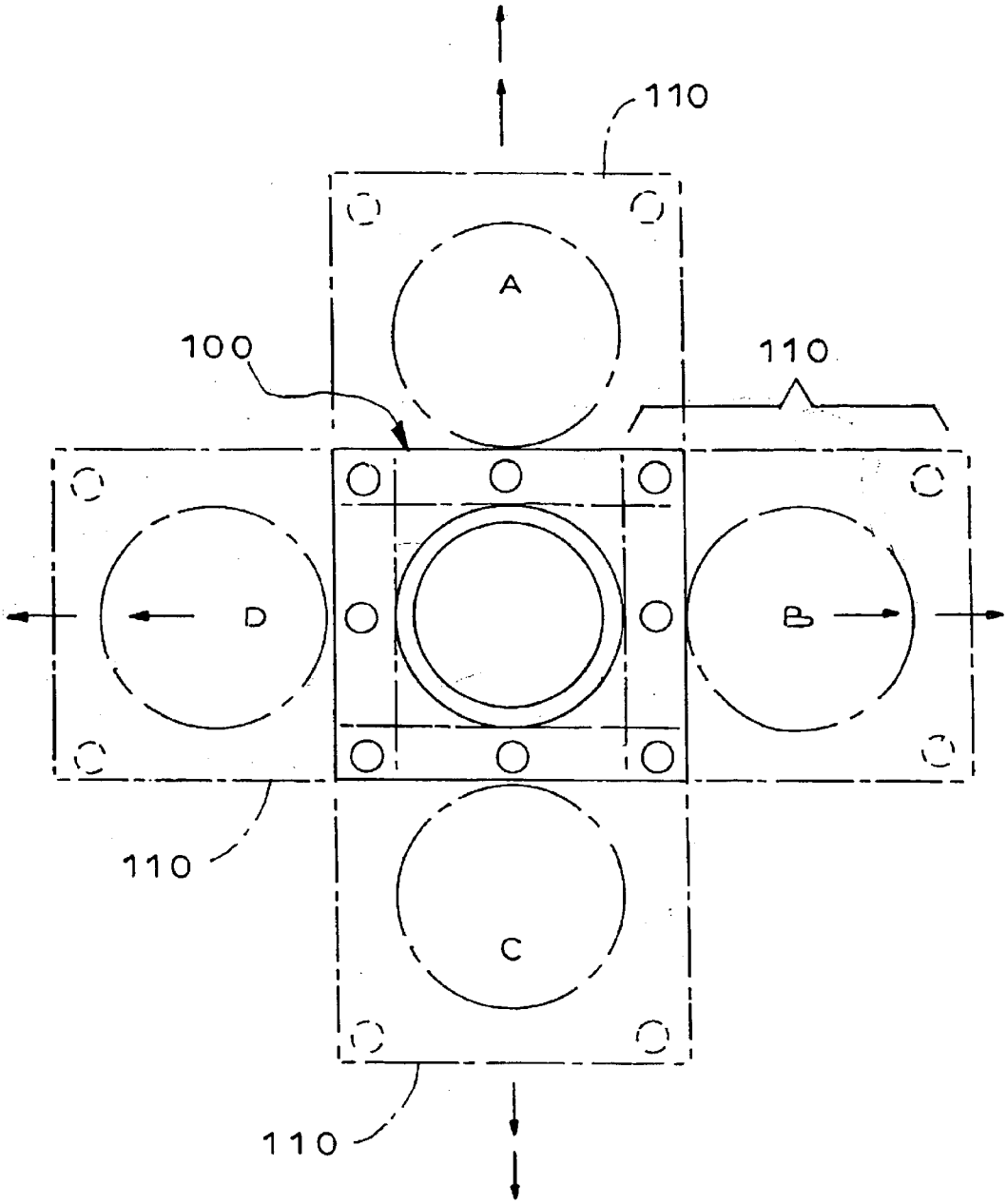
FIG. 3 is a view similar to FIG. 2, but showing in phantom line possible alternative stable open orientations where the one plate is moved the full distance along an orthogonal axis.

(a) Thus, as illustrated in FIGS. 2–3 by the phantom line dispositions A, B, C and D, the first and second plates 110, 130 may be independently relatively linearly translatable along orthogonal axes in a plane (that is, upwardly, downwardly, to the right, or to the left in the plane of the drawing). The plate may be moved substantially for the full length of a side (more precisely, the distance between two adjacent corner magnets), as indicated by the double arrows of FIG. 3, or one half that length (more precisely, the distance between a midpoint magnet and a corner magnet), as illustrated by the single arrows of FIG. 2.

Figure 4:
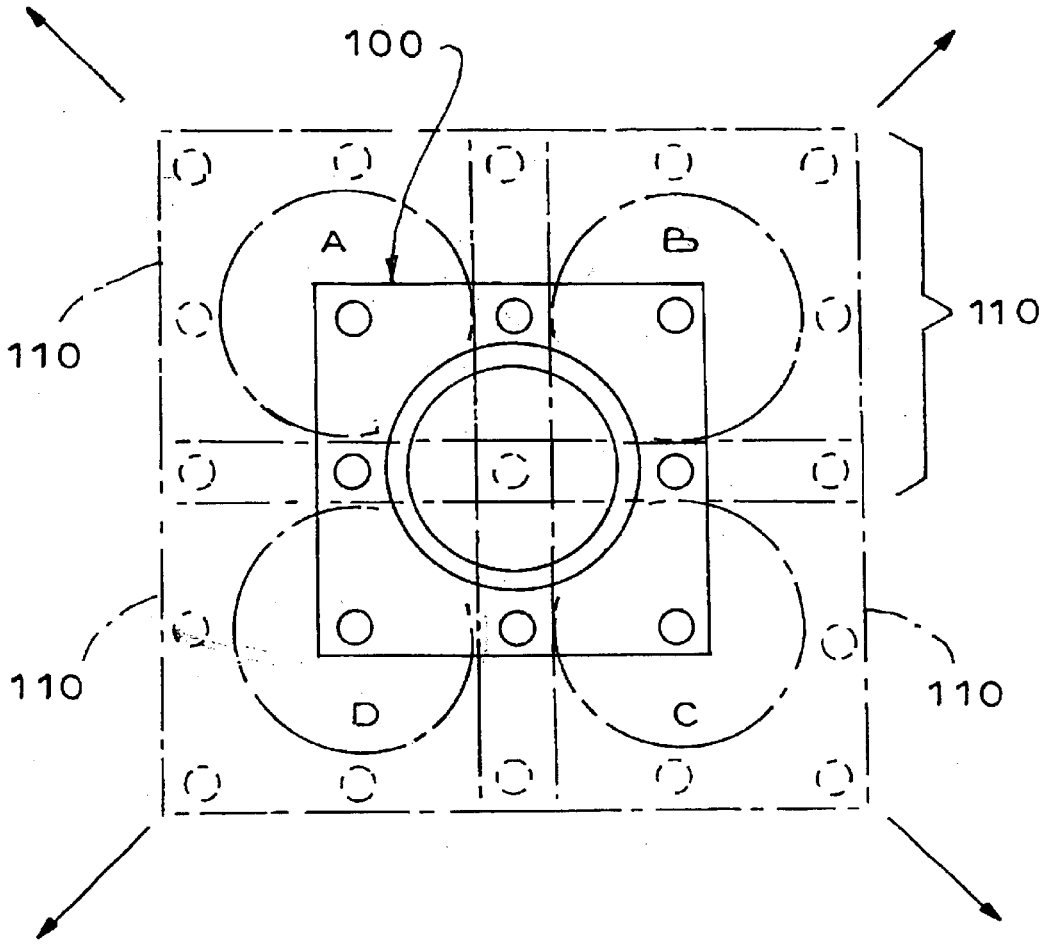
FIG. 4 is a view similar to FIG. 2 but showing in phantom line possible alternative stable open orientations where one plate is moved half-way along a diagonal axis.

(b) Alternatively, as illustrated in FIG. 4 by the phantom line dispositions A, B, C and D, the first and second plates 110, 130 may be independently relatively linearly translatable along diagonal axes in a plane substantially the distance between the center of the plate and a corner magnet (in either direction along either diagonal axis), thereby to enable two midpoint first magnets to become superposed with two midpoint second magnets, as illustrated by the single arrows, thus, forming another stable open orientation. (It will be appreciated that independent relative translation linearly along diagonal axes for substantially the full length of the diagonal axis between two exposed corner magnets does not produce a truly stable open orientation, as there is only the one first corner magnet superposed on the one second corner magnet rather than at least two first magnets superposed on two second magnets, as necessary to provide stability.)

Figure 5:
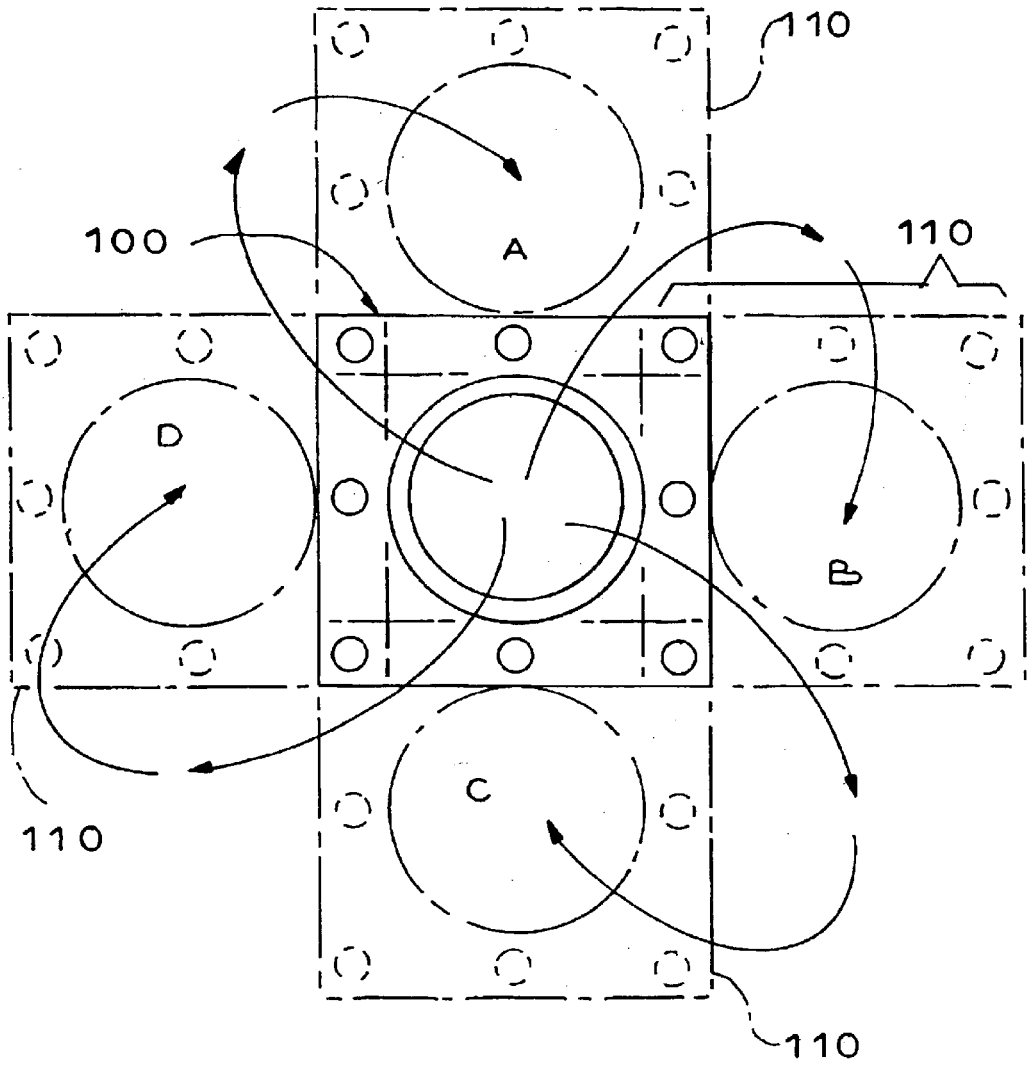
FIG. 5 is a view similar to FIG. 2 but showing in phantom line possible alternative stable open orientations where one plate is pivoted about a magnetic axis.

(c) Further, as illustrated in FIG. 5 by the phantom line dispositions A, B, C and D, the first and second plates 110, 130 may be independently relatively pivotable about one of the magnetic axes 102 until one of the newly separated first or second magnets of an originally superposed pair mates with another newly separated second or first magnet. It will be appreciated that typically this type of translation is limited to pivoting about corner magnets as opposed to midpoint magnets. The first and second plates 110, 130 are relatively pivotable about at least one of the magnetic axes 102 between a stable closed orientation and at least two stable open orientations, as indicated by the double arrow. Each of the magnets is preferably disposed inwardly of the peripheries of its respective plate in the closed orientation so that each magnetic axis 102 of the article 100 is similarly disposed inwardly of the plate peripheries.

Where the transformation is by pivoting, one of the superposed pairs remains superposed throughout movement between adjacent orientations (whether between an adjacent open and closed orientations or between two adjacent open orientations). On the other hand, where the transformation is by linear translation along either orthogonal axes or diagonal axes, no superposed pair remains superposed throughout movement between adjacent orientations. In other words, movement along an orthogonal axis or a diagonal axis causes a separation of each superposed pair of magnets (and possibly the formation of new superposed pairs in the new orientation). As used herein, two orientations are deemed "adjacent" only if there is no intermediate stable orientation therebetween.

The three modes of translation described herein above may be repeated, reversed or combined as necessary to effect desired specific orientations in manners which will become readily apparent to those skilled in the art. Thus the half orthogonal translation of FIG. 2 may be repeated along the same axis to obtain the full orthogonal translation of FIG. 3, or pivotal translation of FIG. 5 may be followed by the half diagonal translation of FIG. 2, etc. Indeed, the pivotal translation of FIG. 5 may be continued until one plate has assumed each of the alternate open stable configurations A–D relative to a stationary plate.

In addition to the aforementioned three modes of translation of the plates, it will be appreciated that the first plate 110 and the first magnets 112–128 are readily manually separable from the second plate 130 and the second magnets 132–148 to deconstruct the article 100. The first plate 110 and the first magnets 112–128 may then be readily manually reattachable to the second plate 130 and the second magnets 132–148 to reconstitute the article 100. If after separation, one of the two plates 110, 130 is rotated relative to the other, it will be appreciated that new superposed pairs of the first and second magnets would be formed upon manual reattachment of the first and second plates. Indeed, while the foregoing description assumes that the first and second plates are separated from a closed orientation and returned to a closed orientation, one could also separate the plates from an open orientation and return them to the same open orientation, another open orientation, or a dosed orientation. As the article 100 is devoid of a physical pin connecting the first and second plates 110, 130, that manual separation or reattachment of the plates is easily performed without any threading of the plates onto or off of a physical pin.

In principle, adjacent facing surfaces of the first and second magnets are flush with or very slightly recessed relative to adjacent facing surfaces of the first and second plates, respectively. However, slight projections of the magnets from their respective plates may be used to ensure the production of an audible clicking sound as the plates are moved from one stable orientation to another. The clicking sound may be desirable to audibly signal that the new orientation has been attained or simply to attract attention to the article. On the other hand, if the clicking sound is found undesirable, the magnets may be recessed slightly below the facing surface of the plate, thereby to mute the clicking sound.

Interestingly, while opposed major surfaces of each magnet are of opposite polarity (that is, represent different magnetic poles) and the facing surfaces of a superposed pair of magnets are of opposite polarity, it is not critical that all of the first magnets and all of the second magnets be of the same polarity. Thus there may be superposed pairs of one polarity (e.g., N-S-N-S) and other superposed pairs of the opposite polarity (e.g., S-N-S-N). However, this is not recommended since it can severely reduce the number of possible orientations which the plates can assume while still being magnetically maintained together reliably as a unit.

Each of the magnets is disposed inwardly of the peripheries of its respective plate in the closed orientation so that each magnetic axis 102 of the article 100 is similarly disposed inwardly of the peripheries.

In a preferred embodiment, the article 100 is incorporated in a cosmetic case, the first or upper plate 110 defining the cover of the cosmetic case and the second or lower plate 130 defining the base of the cosmetic case, the base 130 and cover 110 being relatively transformable between the closed and open stable orientations.

Where the article is a cosmetic case, at least one of the plates may carry at least two different cosmetics 154, each of the different cosmetics being individually and exclusively exposed for use by at least one respective stable orientation. Where particular plates contain a plurality of different cosmetics, the different cosmetics are preferably laid out in such a manner that the consumer—by an appropriate use of orthogonal translation, diagonal translation, pivoting and combinations thereof—is able to expose for use a particular cosmetic by itself (that is, without any other cosmetic on the plate being exposed). Thus, while a given plate may carry a plurality of cosmetics, the case may be opened so as to expose only one of the plurality of cosmetics for use at a time (that is, by a given stable open orientation). The non-magnetic material of at least one of the plates 110, 130 is preferably transparent or translucent plastic.

Figure 6:
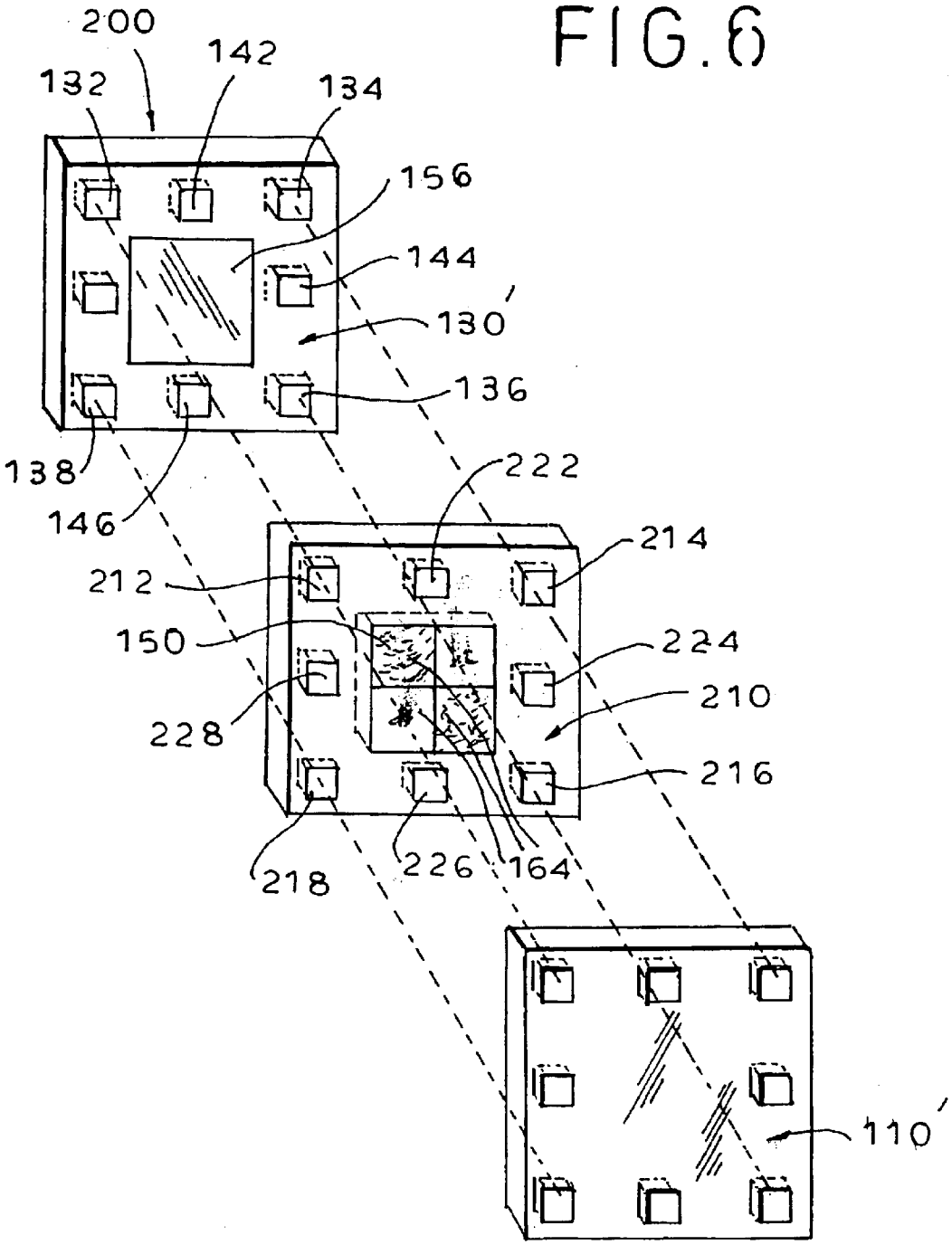
FIG. 6 is a view similar to FIG. 1C, but of a second embodiment.

While the concept of the present invention has been described and illustrated herein above with respect to a two plate embodiment—that is, an embodiment having only a first plate 110 and a second plate 130—clearly the principles of the present invention are applicable to embodiments having three or more plates. Thus, referring now to FIG. 6 in particular, in a three plate embodiment, generally designated 200, there is additionally a third plate 210 of non-magnetic material and a plurality of spaced-apart third magnets 212–228 disposed in the third plate 210 for movement therewith. The third plate 210 and the third magnets 212–228 are disposed at least partially intermediate the first and second plates 110', 130' and respective first and second magnets 112–128 and 132–148. The first, second and third plates 110', 130' and 210 are generally juxtaposed and independently transformable in respective parallel planes transverse to the magnetic axes between a stable closed orientation and a plurality of stable open orientations.

The first and second plates 110', 130' of the second embodiment 200 are similar to the first and second plates 110, 130 of the first embodiment 100 except that the first plate 110' is illustrated as transparent, and the second plate 130' is illustrated a having a mirror 156 disposed on a protected inner surface thereof. Additionally, the magnets 112–128 and 132–148 are illustrated as being square (that is, as rectangular parallelopipeds) rather than circular as in the first embodiment 100. Preferably the square magnets are in actuality non-square rectangles in plan with the long axes of the rectangles being aligned with the diagonals of the plate (for the corner magnets) and with the midlines of the plate (for the midpoint magnets).

In the stable closed orientation the first, second and third plates 110', 130' and 210 are essentially superposed and at least a plurality of the first magnets 112–128, at least a plurality of the second magnets 132–148, and at least a plurality of the third magnets 212–228 form essentially superposed trios. Each such superposed trio contains one of the first magnets 112–128, one of the second magnets 212–228 and one of the third magnets 132–148, and furthermore defines one of the magnetic axes 102. In each of the superposed trios, the first, second and third magnets 112–128, 132–148, and 212–228 are generally parallel and in the same magnetic orientation. In each stable open orientation the first, second and third plates 110', 130' and 210 are overlapping but essentially not superposed. The first, second and third magnets of at least one of the superposed trios of magnets in the closed orientation are essentially not superposed in the stable open orientation although two of the magnets may remain superposed.

In a preferred compact case according to the second embodiment 200, the top plate 110' is transparent, the third or middle plate 210 carries cosmetics (which can be seen through the transparent first plate), and the second plate 130' is mirrored on its protected inner (upper) surface so that the user can look into the mirror 156 of the second plate while applying the cosmetics of the third plate. Indeed, the third or middle plate 210 is preferably formed with cosmetics on both of the outer surfaces thereof so as to provide the user of the compact case with even more choice in the selection of cosmetics being applied at any given time. Such middle plate 210 acts as a "double sided product layer," with each side of the middle plate including as many as three or four different cosmetic products. As used herein, the term "cosmetic" broadly encompasses implements for application of the cosmetics—e.g., a powder or blush brush, a mascara or lipstick applicator, etc.

In the embodiment 200, the magnets of the middle plate 210 are of sufficient thickness and strength that they are able to interact with the respective magnets of plates 110', 130' on either side of the middle plate 210. Indeed, to achieve the economies of scale, to minimize the need for separate production of different plates, and generally to provide modularity, the magnets in the upper and lower (first and second) plates may be similar to the magnets of the middle (third) plate, thereby to allow rearrangement of the order of the plates by the customer as desired. Putting aside such mundane issues as why one might want to have a transparent cover as other than the top plate in a stack of plates, it would be apparent that the potential customer desiring to have a compact case according to the present invention would appreciate the option of selecting from a large number of different plates (some having different cosmetics, some having mirrors, some being transparent, etc.) only those of interest and then building from those a stack of plates constituting a personalized cosmetic case. The overall height of a stack and the order of the plates in the stack would be determined by the customer.

The cosmetic case is preferably sized to be comfortably grasped by a feminine hand. The strength of the magnets is determined as an appropriate compromise between the need to maintain the compact case in its closed stable configuration against accidental incidental forces which might tend to open the same (for example, within a handbag or purse) and the desirability of having the compact case easily movable by a feminine hand from its closed orientation to one of its stable open orientations, preferably using only one hand. Clearly, in other applications of the present invention (other than the cosmetic case) the multi-stable magnetic article may be substantially larger and more adapted for two-handed use.

In the two-plate fist embodiment 100 and in the three or more plate second embodiment 200 (at least where it is known which plates will be the topmost and bottommost of the plates), the peripheral or outer long edges of the closed article (whether formed by the topmost or bottommost plate) are preferably curved or rounded to provide an appealing appearance which facilitates manipulation by the user and minimizes the possibility of catching on other articles in the environment (which may be a purse or articles in a purse).

In this regard it will be appreciated that the peripheral configurations of the plates need not be identical, as illustrated, but may vary from one to another for either functional or aesthetic purposes.

As will be appreciated by those skilled in the art, each plate may be formed of a plurality of different components. For example, each plate may be comprised of a base providing spaces for the receipt of corner and midpoint magnets, as well as concavities for containers having cosmetics therein, and a thin planar top adapted to fit over the base to retain the magnets and containers therein, the cosmetics being exposed through one or more strategically placed apertures in the top.

To summarize, the present invention provides a multi-stable magnetic article, the plates being movable between a stable closed orientation and a plurality of stable open orientations. The plates are transformable by being independently relatively pivotable about a pivot axis, or translatable independently relatively translatable along orthogonal axes, or being independently relatively translatable along diagonal axes. The articles is simple and inexpensive to manufacture, use and maintain.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A multi-stable magnetic article defining a plurality of spaced apart parallel magnetic axes, comprising:

(A) a first plate of non-magnetic material;

(B) a plurality of spaced apart first magnets disposed in said first plate for movement therewith;

(C) a second plate of non-magnetic material; and (D) a plurality of spaced apart second magnets disposed in said second plate for movement therewith;

said first and second plates being generally juxtaposed and independently transformable in respective parallel planes transverse to the axes, between:

(i) a stable closed orientation wherein said first; and second plates are essentially superposed, and wherein at least a plurality of first magnets and at least a plurality of said second magnets form essentially superposed pairs, each said superposed pair containing one of said first magnets and one of said second magnets and defining one of said axes; and (ii) a plurality of stable open orientations wherein said first and second plates are overlapping but essentially not superposed, and wherein said first and second magnets of at least one of said superposed pairs of magnets in said closed orientation are essentially not superposed in said open orientation;

in each of said superposed pairs, said first and second magnets being in the same magnetic orientation.

2. The article of claim 1 wherein said first plate and said first magnets are readily manually separable from said second plate and said second magnets to deconstruct said article.

3. The article of claim 2 wherein said first plate and said first magnets are readily manually attachable to said second plate and said second magnets to reconstitute said article.

4. A cosmetic case incorporating the article of claim 1, said first plate defining a base of said case and said second plate defining a cover of said case, said base and cover being relatively transformable between said closed and open orientations.

5. The article of claim 1 wherein the article is devoid of a physical pin connecting said first and second plates.

6. The article of claim 1 wherein said first and second plates are relatively pivotable about at least one said axis to an additional stable open orientation.

7. The article of claim 1 wherein the article is at least tristable.

8. The article of claim 1 wherein the article is at least quadristable.

9. The article of claim 1 wherein the article is at least pentastable.

10. The article of claim 1 wherein adjacent facing surface of said first and second magnets are flush with or recessed relative to adjacent facing surfaces of said first and second plates, respectively.

11. The article of claim 1 wherein there are three of said first magnets and three of said second magnets.

12. The article of claim 1 wherein there are at least four of said first magnets and at least four of said second magnets.

13. The article of claim 1 wherein at least one of said superposed pairs is in a different magnetic orientation than another of said superposed pairs.

14. The article of claim 1 wherein in said closed orientation all of said first magnets and all of said second magnets form said superposed pairs.

15. The article of claim 1 wherein one of said superposed pairs remains superposed throughout movement between adjacent orientations.

16. The article of claim 1 wherein no superposed pair remains superposed throughout movement between adjacent orientations.

17. The article of claim 1 wherein at least one superposed pair separates during movement between adjacent orientations.

18. The article of claim 1 wherein at least one superposed pair separates during movement between adjacent orientations, with said first magnet thereof becoming newly superposed with another of said second magnets.

19. The article of claim 1 wherein said non-magnetic material of at least one of said plates is transparent or translucent.

20. The article of claim 1 wherein said first and second magnets are rectangular and substantially fiat.

21. The article of claim 1 wherein said plates are square in plan.

22. The article of claim 1 wherein said plates are circular in plan.

23. The article of claim 1 wherein said plates are oval in plan.

24. The article of claim 1 wherein opposed major surfaces of each magnet are of opposite polarity.

25. The article of claim 1 wherein each article axis is disposed inwardly of the peripheries of said first and second plates in said closed orientation.

26. The article of claim 1 wherein said plates are square in plan, and said magnets are disposed adjacent respective corners thereof.

27. The article of claim 26 wherein said magnets disposed in each plate are equidistantly spaced apart.

28. The article of claim 1 wherein said magnets disposed in each plate define the vertices of a polygon, irrespective of the configuration of the plate.

29. The article of claim 28 wherein said polygon is a regular polygon.

30. The article of claim 1 wherein said first and second plates are transformable by being independently relatively pivotable about one of said magnetic axes.

31. The article of claim 1 wherein said first and second plates are transformable by being independently relatively linearly translatable along orthogonal axes.

32. The article of claim 1 wherein said first and second plates are transformable by being independently relatively linearly translatable along diagonal axes.

33. The article of claim 1 wherein said plates are square in plan and there are eight of said first magnets and eight of said second magnets, four of each being disposed at respective corners of each plate and four of each being disposed at respective midpoints intermediate the corners of each plate.

34. The article of claim 1 wherein said article is a cosmetic case and at least one of said plates carries at least two different cosmetics, each of the different cosmetics being individually and exclusively exposed for use by at least one respective stable open orientation.

35. The article of claim 1 wherein said plates, including their respective magnets, are readily manually separable and readily manually attachable in the same or a different sequence of plates.

36. The article of claim 1 wherein said first and second plates are square, and said first and second magnets are generally rectangular in plan and physically aligned along diagonals of said plates.

37. The article of claim 1 wherein said first and second magnets are cylindrical.

38. A multi-stable magnetic article defining a plurality of spaced apart parallel magnetic axes comprising:

(A) a first article plate of non-magnetic material;

(B) a plurality of spaced apart first magnets disposed in said first plate for movement therewith;

(C) a second plate of non-magnetic material;

(D) a plurality of spaced apart second magnets disposed in said second plate for movement therewith; and (E) a third plate of non-magnetic material; and (F) a plurality of spaced apart third magnets disposed in said third plate for movement therewith;

said third plate and said third magnets being disposed at least partially intermediate said first and second plates and magnets;

said first, second and third plates being generally juxtaposed and independently transformable in respective parallel planes transverse to the axes, between:

(i) a stable closed orientation wherein said first, second and third plates are essentially superposed, and wherein at least a plurality of said first magnets, at least a plurality of said second magnets and at least a plurality of said third magnets form essentially superposed trios, each said superposed trio containing one of said first magnets, one of said second magnets and one of said third magnets and defining one of said axes; and (ii) a plurality of stable open orientations wherein said first, second and third plates are overlapping but essentially not superposed, and wherein said first, second and third magnets of at least one of said;

superposed trios of magnets in said closed orientation are essentially not superposed in said open orientation;

in each of said superposed trios, said first, second and third magnets being generally parallel and in the same magnetic orientation.

39. The article of claim 38 wherein an outer one of said plates is transparent.

40. The article of claim 1 additionally comprising:

(E) a third plate of non-magnetic material; and (F) a plurality of spaced apart third magnets disposed in said third plate for movement therewith;

said third plate and said third magnets being disposed at least partially intermediate said first and second plates and magnets;

said first, second and third plates being generally juxtaposed and independently transformable in respective parallel planes transverse to the axes, between:

(i) a stable closed orientation wherein said first, second and third plates are essentially superposed, and wherein at least a plurality of said first magnets, at least a plurality of said second magnets and at least a plurality of said third magnets form essentially superposed trios, each said superposed trio containing one of said first magnets, one of said second magnets and one of said third magnets and defining one of said axes; and (ii) a plurality of stable open orientations wherein said first, second and third plates are overlapping but essentially not superposed, and wherein said first, second and third magnets of at least one of said superposed trios of magnets in said closed orientation are essentially not superposed in said open orientation;

in each of said superposed trios, said first, second and third magnets being generally parallel and in the same magnetic orientation.

41. The article of claim 1 wherein said article consist of said first plate and first magnets and second plate and second magnets.

* * * * *